US005478165A

United States Patent [19]

Correia et al.

[11] Patent Number: 5,478,165

[45] Date of Patent: Dec. 26, 1995

[54] CURB PAVING STONE AND ANCHORING SYSTEM

[76] Inventors: Horacio Correia, 1675 Rougemont; Charles Ciccarello, 8750 San Francisco, both of Brossard, Quebec, Canada

[21] Appl. No.: 212,142

[22] Filed: Mar. 14, 1994

[51] Int. Cl.[6] ..... E01C 11/22

[52] U.S. Cl. ..... 404/7; 52/102

[58] Field of Search ..... 404/7, 8; 52/102; 40/612

[56] References Cited

U.S. PATENT DOCUMENTS 3,472,133 10/1969 Ziehm, Jr. ..... 404/7
4,971,475 11/1990 Castonguay et al. ..... 404/7
5,230,187 7/1993 Reimann ..... 52/102
5,261,760 11/1993 Castonguay et al ..... 404/7

*Primary Examiner*—William P. Neuder

[57] ABSTRACT

A precast concrete curb stone which is comprised of a curb section having a front wall, a top wall and opposed side walls. The curb stone has a rear wall with an anchoring projection formed integral therewith and which extends flush with a flat bottom wall of the curb section. The projection has a recessed top anchoring wall disposed spaced a predetermined distance below the section top wall. An anchoring cavity is provided in the top anchoring wall and spaced from a rear wall of the anchoring projection. A peg anchor is adapted for connection with the anchoring cavity of the anchoring projection. The peg anchor has a hook-shaped end adapted for engagement in the anchoring cavity and an elongated stem having a length sufficient to extend into a ground surface behind the rear wall of the anchoring projection.

7 Claims, 3 Drawing Sheets

CURB PAVING STONE AND ANCHORING SYSTEM

TECHNICAL FIELD

The present invention relates to a precast concrete curb stone which has an anchoring projection in a rear wall thereof formed with a shallow anchoring cavity in a top wall thereof so that a peg anchor can connect the curb stone in a ground surface rearwardly of the curb stone.

BACKGROUND ART

Various precast concrete curb stones are known, and these are usually positioned along the edges of walkways or driveways to provide a clean delineation thereof and at the same time providing an abutment edge therealong with advantages as is well known in the art. The present invention relates to a novel construction of such precast concrete curb stones and which may be anchored into a ground surface from the rear thereof by the use of peg anchors.

SUMMARY OF INVENTION

It is a feature of the present invention to provide a precast concrete curb stone having an anchoring projection in a rear .wall thereof with an anchoring cavity provided on a top wall of the projection adjacent an end wall thereof to be engaged by a hook-shaped end of a peg anchor which is driven into a ground surface behind the curb stone.

According to the above feature, from a broad aspect, the present invention provides a precast concrete curb stone which is comprised of a curb section having a front wall, a top wall and opposed side walls. The curb stone has a rear wall with an anchoring projection formed integral therewith and which extends flush with a flat bottom wall of the curb section. The projection has a recessed top anchoring wall disposed spaced a predetermined distance below the curb section top wall. An anchoring cavity is provided in the top anchoring wall and spaced from a rear wall of the anchoring projection. A peg anchor is adapted for connection with the anchoring cavity of the anchoring projection. The peg anchor has a hook-shaped end adapted for engagement in the anchoring cavity and an elongated stem having a length sufficient to extend into a ground surface behind the rear wall of the anchoring projection.

SUMMARY OF INVENTION

A preferred embodiment of the present invention will now be described with reference to the accompanying drawings in which.

DESCRIPTION OF PREFERRED EMBODIMENTS

Figure 1:
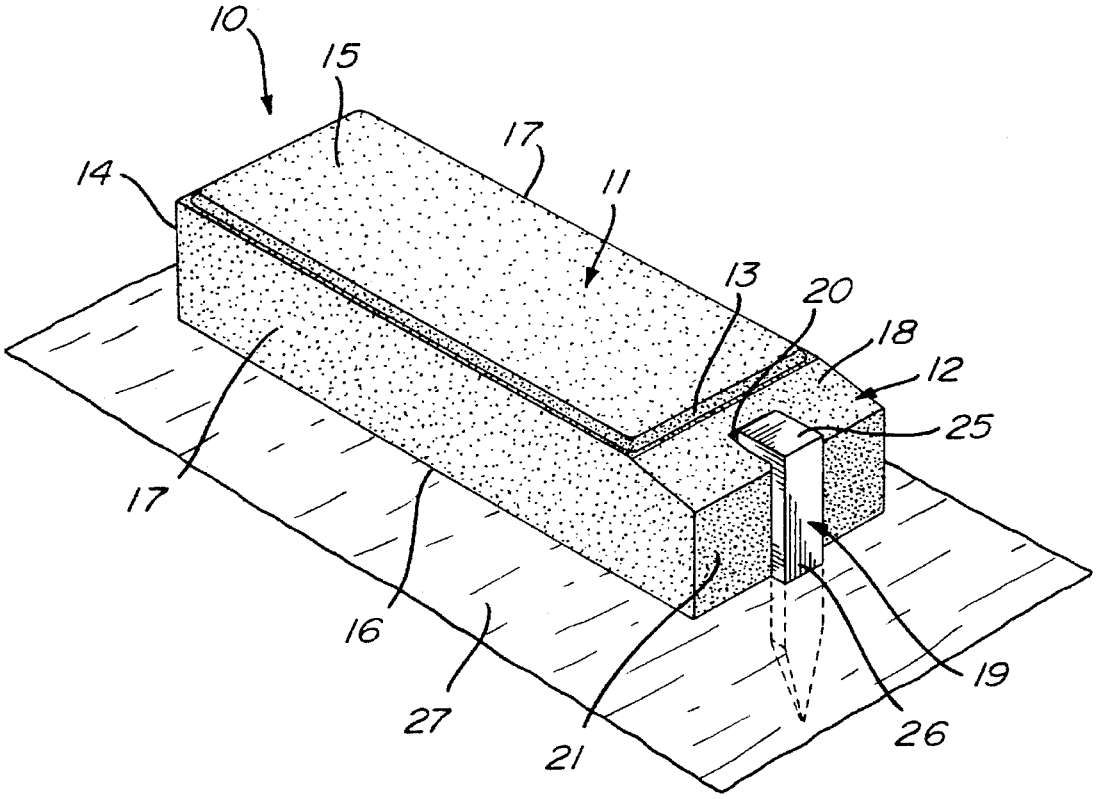
FIG. 1 is a perspective view showing a precast concrete curb stone embodying the anchoring projection and using a peg anchor of the present invention.

Referring now to the drawings, and more particularly to FIG. 1, there is shown generally at 10 a precast concrete curb stone constructed in accordance with the present invention. The stone 10 comprises a curb section 11 and an anchoring projection 12 formed integral therewith and extending from a rear wall 13 of the curb section 11. The curb section has a front wall 14, a top wall 15, a bottom wall 16 and opposed side walls 17.

As can be seen, the anchoring projection 12 has a top wall 18 which is recessed below the top wall 15 of the curb section 11 to conceal the peg anchor 19 which is secured to an anchoring cavity 20 which is disposed in the top wall 18 of the anchoring projection 12 adjacent the rear wall 21. When the peg anchor 19 is engaged, it is recessed and concealed below the top wall 15 of the curb stone rearwardly of the curb section 11.

Figure 4A:
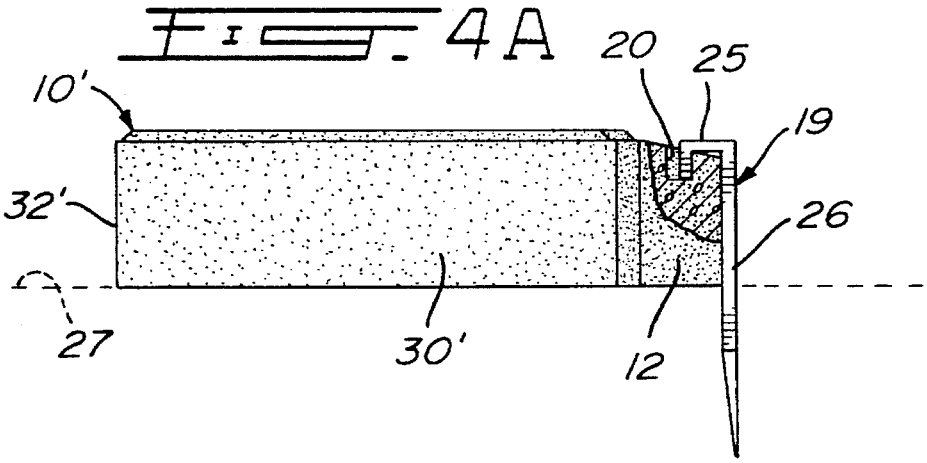
FIG. 4A is a side view showing the stone of FIG. 2A anchored in the ground surface by the peg anchor of the present invention.
Figure 4B:
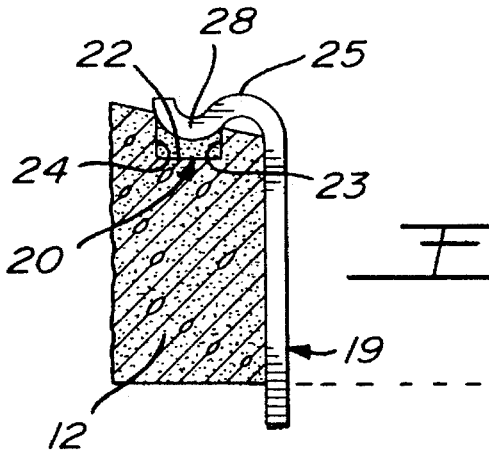
FIG. 4B is an enlarged fragmented side view showing a modification of the peg anchor of the present invention.

With further reference to FIGS. 4A and 4B, it can be seen that the anchoring cavity 20 is a shallow cavity defining a bottom wall 22, a rear wall 23, and a front wall 24. The cavity 20 is an elongated cavity disposed adjacent the rear wall 21 of the anchoring projection and extends substantially parallel thereto and disposed a predetermined distance therefrom so as to receive the hook-shaped end 25 of the peg anchor 19. The peg anchor 19 also has an elongated stem 26 of sufficient length to extend into a ground surface 27 behind the rear wall 21 of the anchoring projection to substantially immovably secure the curb stone 10 on top of the ground surface 27.

As shown in FIG. 4B, the hook-shaped end 25 of the anchor may have an S-shaped formation defining a hooking elbow 28 to engage within the anchoring cavity 20 when the anchor is driven into the ground surface 27, as shown in FIG. 4A. As shown in this Figure, the peg anchor is formed by a rod of circular cross-section constructed from metal and preferably aluminum or galvanized steel treated to resist corrosion. The peg anchor 19 may also be molded from a suitable plastics material. As shown in FIGS. 1 and 4A, the peg anchor may also be constructed from flat metal stock so as to form a peg of rectangular cross-section having an inverted U-shaped hook end 25 to engage within the cavity 20. The hook-shaped end 25 may also be angulated to sit flush on the top wall 18 of the anchoring projection 12 between the cavity 20 and the rear wall 21.

Referring now to FIGS. 2A to 3B, there is shown the construction of a precast concrete curb stone 10' and 10" which form a curved curb section formed by two or more, herein three, fractionable stone portions 30, 30' and 30". The side walls 31, 31' and 31" of these stone portions, when fractionated, converge towards the front end 32, 32', and 32" of the stone sections whereby the front face of the curved section is concave where the front walls extend at angles from one another. Fractionable groove 33 are provided between the top wall 34, 34' and 34" of the stone portions and delineate the side walls of the stone sections when these stone portions are fractionated. Of course, these stones only need to be fractionated if a different type stone is required to be abutted against a side wall of the stone portion 30 which is the central stone, As also herein shown, the anchoring projection 12 is formed integrally with the central stone portion 30 to connect the composite stone to a ground surface, as previously described.

Figure 3A:
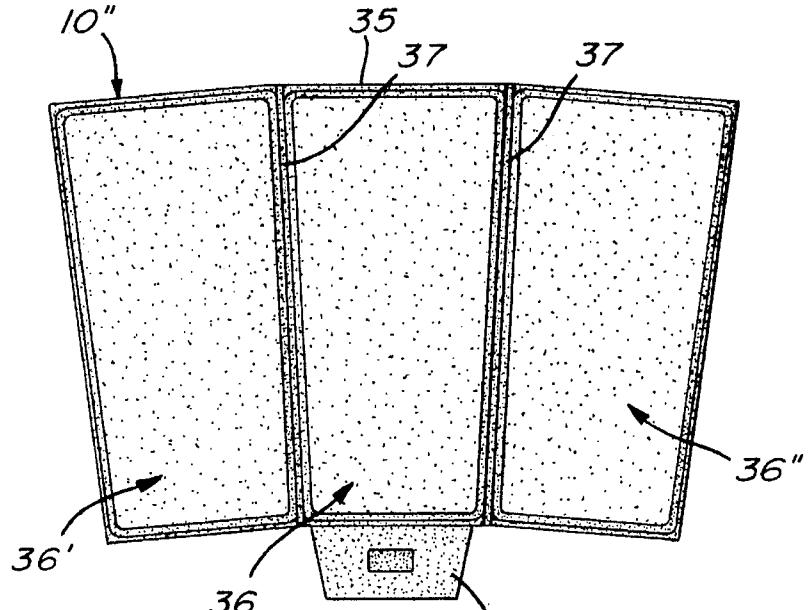
FIG. 3A is a top view illustrating a precast concrete curb stone having the reverse curvature of the stone as shown in FIG. 2A.
Figure 3B:
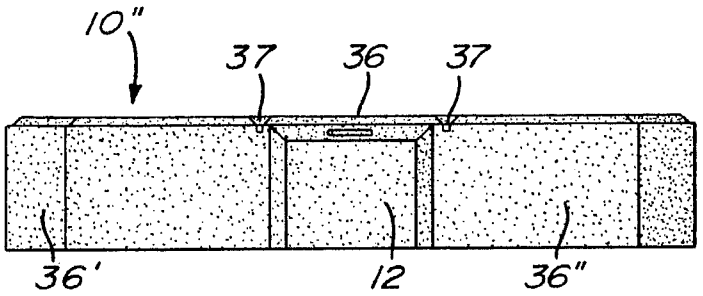
FIG. 3B is an end view of FIG. 3A.
Figure 2A:
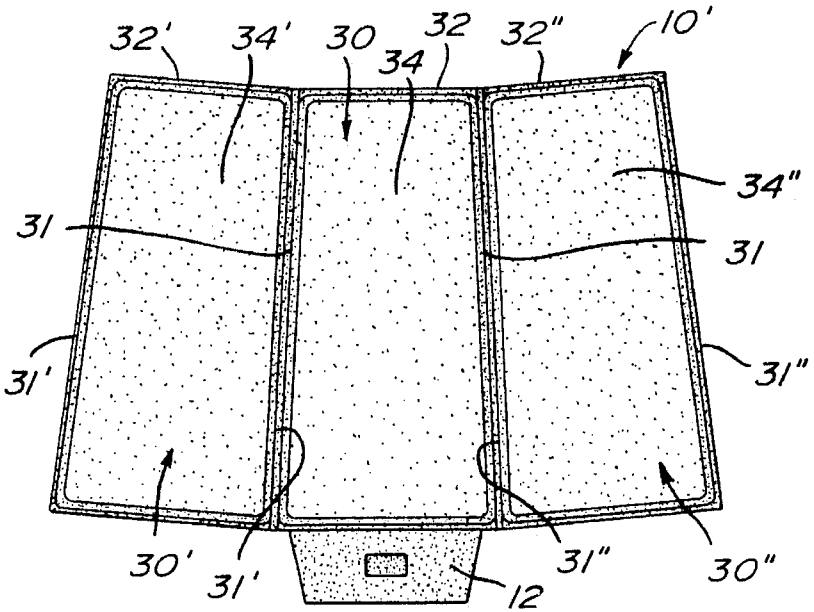
FIG. 2A is a top view illustrating the construction of a precast concrete curb stone formed with two or more fractionable stone portions and having an anchoring projection.
Figure 2B:
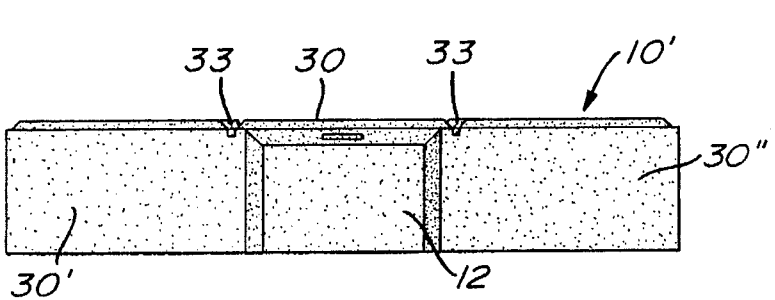
FIG. 2B is an end view of FIG. 2A.

FIGS. 3A and 3B show a stone 10" similar to the curb stone 10', as shown in FIG. 2A, but with the front face 35 of the stone 10" being convex rather than concave. It is also formed of three stone portions 36, 36' and 36" which may be fractionated along the fractionable grooves 37 which are also provided with an anchoring projection 12, similar to that described for FIGS. 1 and 2A.

Figure 5:
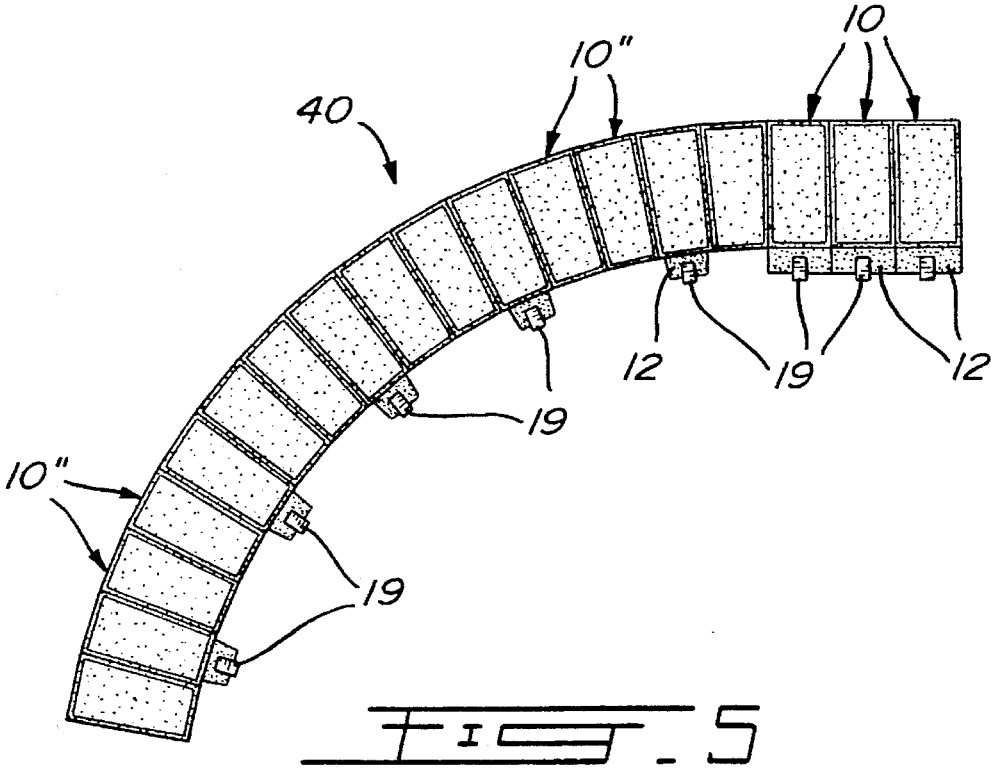
FIG. 5 is a plan view showing a plurality of curb stones disposed side by side to form a curved curb.

Referring now to FIG. 5, there is shown the manner in which these stones are interconnected together to form a curb 40. As herein shown, arcuately shaped composite stones 10" are positioned side by side to form a curb section and are anchored into the ground by their anchor pegs 19. Rectangular curb stones 10 or fractionated stone portions, such as 30, 30' and 30", can be positioned side by side and also interconnected by anchor pegs 19 to form a straight curb section. It is also conceivable that these straight curb sections may be elongated rectangular blocks having one or more pegs 19 connected in an elongated anchoring cavity 20 or to a respective one of two or more anchoring cavities 20 disposed along the top wall of an elongated anchoring projection 12 that may be provided therealong.

It is within the ambit of the present invention to cover any obvious modifications of the examples of the preferred embodiment described herein, provided such modifications fall within the scope of the appended claims.

We claim:

1. A precast concrete curb stone comprising a curb section having a front wall, a top wall and opposed side walls, said curb stone having a rear wall with an anchoring projection formed integral therewith, said projection extending flush with a flat bottom wall of said curb section, said projection having a recessed top anchoring wall disposed spaced a predetermined distance below said curb section top wall and sloped rearwardly downwards, an anchoring cavity in said top anchoring wall spaced from a rear wall of said anchoring projection, said anchoring cavity being a shallow slot in said sloped top anchoring wall whereby a rear edge of said cavity is lower than a front edge thereof spaced from opposed side walls and said rear wall of said anchoring projection, a peg anchor adapted for connection with said anchor cavity of said anchoring projection, said peg anchor having a hook-shaped transverse end adapted for engagement in said anchoring cavity from said rear edge, and an elongated stem having a length sufficient to extend into a ground surface behind said rear wall of said anchoring projection.

2. A precast concrete curb stone according to claim 1 wherein said curb section is a curved curb section formed by two or more fractionable stone portions, said opposed side walls being converging side walls, said front wall of said portions extending at angles from one another, and a fractionable groove in said top wall delineating said stone portions and some of said side walls.

3. A precast concrete curb stone according to claim 2 wherein said anchoring projection is formed integral with said rear wall of one of said stone portions.

4. A precast concrete curb stone according to claim 1 wherein said peg anchor is an anchor rod, said hook-shaped end of said anchor rod having a transverse S-shaped formation defining a hooking elbow to engage within said anchoring cavity, said anchor rod being a metal rod of circular cross-section.

5. A precast concrete curb stone according to claim 1 wherein said peg anchor is a flat peg of rectangular cross-section having an inverted U-shaped hook end.

6. A precast concrete curb stone according to claim 1 wherein said recessed top anchoring wall is spaced from said top wall of said curb section a distance sufficient to accommodate said hook-shaped end of said peg anchor such that when engaged in said anchoring cavity it lies below a plane of said top wall of said curb section.

7. A precast concrete curb stone according to claim 1 wherein said front wall of said curb section is a straight wall, said opposed side wall converging toward one another rearwardly of said front wall.

* * * * *